United States Patent [19]

Moucka

[11] 3,952,350

[45] Apr. 27, 1976

[54] GRAVITY WEIGHT TRIGGER FOR A LIFE RAFT

[76] Inventor: Emil Moucka, Rte. 4, Ennis, Tex. 75119

[22] Filed: Oct. 4, 1974

[21] Appl. No.: 512,000

[52] U.S. Cl. ..... 9/11 A; 114/68

[51] Int. Cl.[2] ..... B63C 9/04

[58] Field of Search ..... 9/11 A, 11 R, 14, 33, 9/316, 319; 114/68; 222/500

[56] References Cited

UNITED STATES PATENTS

| | | | |
|---|---|---|---|
| 3,016,858 | 1/1962 | Johnson | 114/39 |
| 3,165,763 | 1/1965 | Gaylord | 9/11 R |
| 3,324,816 | 6/1967 | Vogelsang | 114/68 |
| 3,768,761 | 10/1973 | Cramer | 9/11 A |

*Primary Examiner*—Trygve M. Blix
*Assistant Examiner*—Gregory W. O'Connor
*Attorney, Agent, or Firm*—Howard E. Moore; Gerald G. Crutsinger

[57] ABSTRACT

Apparatus to automatically inflate a life raft secured to the side of a boat hull by releasing a pressurized gas from a cylinder when the boat capsizes. The gas release mechanism for the cylinder includes a spring urged valve and a spring loaded plunger arranged to open said valve upon release. The plunger is held in an extended position by a lever arm pivotal about a pin and held by an extending arm connected to weights such that when the boat is overturned the weights pivot away from the lever arm due to the force of gravity, releasing the plunger, thereby releasing gas from the cylinder to inflate the life raft.

11 Claims, 5 Drawing Figures

GRAVITY WEIGHT TRIGGER FOR A LIFE RAFT

BACKGROUND OF THE INVENTION

Each year numerous deaths occur from boating accidents in which the boat is sunk because the passengers had nothing to help them remain afloat and they consequently drowned. Although life jackets are often required they are not ordinarily worn by boaters because of their bulkiness and unattractiveness, thus making them vulnerable to drowning if the boat is capsized due to bad weather or careless operation.

If an emergency wherein a boat is capsized there is usually insufficient time to launch a life raft.

Devices heretofore used to trigger life rafts usually used a water soluble retaining device to hold a spring urged valve closed such that when water contacted the device the retaining device is dissolved releasing the valve which released gas to inflate the life raft. However, these devices are not reliable and do not respond fast enough in emergency situations. In addition, boats are subject to being wetted down from rain and spray from the water in which they are used Thus water soluable devices therefore are unacceptable due to their inadvertent triggering when they become accidently wetted.

SUMMARY OF THE INVENTION

I have devised an apparatus to inflate a life raft when inverted comprising a base member having a deflected end at one end and weights secured to the other end with an arm rotatable about a pin. The deflected end secures one end of a lever arm, and the other end of which has a deflected end and secures a spring urged plunger limiting the movement thereof. When the device is inverted the weights move downwardly and the deflected end of the base member pivots away from the lever arm thus releasing the lever arm which pivots away from the spring urged plunger. The plunger is urged forwardly opening a valve and releasing pressurized gas to inflate the life raft. The device is mounted on the side of a boat preferably at a 45° angle, such that when the boat is rotated about the longitudinal axis approximately 90°, the device will be inverted and inflate the life raft before the boat has completely capsized thus giving the occupants something to keep them afloat in the immediate vicinity of the overturned boat.

The primary object of the invention is to provide a life raft inflating device which is gravity actuated such that when the boat is overturned due to bad weather or a dangerously steep turn, the device is triggered, inflating the life raft.

Another object of the invention is to provide a triggering device for life raft inflating mechanism which is not triggered by water in which the boat is disposed.

Another object of the invention is to provide an automatic triggering device for life raft inflating mechanism which is not dependent upon electrical power and thus subject to failure upon failure of the electrical power source.

A still further object of the invention is to provide a simple and safe life raft inflating device which can be maintained by the average boat owner.

Other and further objects of the invention will become apparent upon referring to the detailed description hereinafter following and to the drawings annexed hereto.

DESCRIPTION OF THE DRAWINGS

Drawings of a preferred embodiment of the invention are annexed hereto so that the invention may be better and more fully understood, in which.

Numeral references are employed to designate parts in the drawings and like numerals designate like parts throughout the various figures of the drawings.

DESCRIPTION OF A PREFERRED EMBODIMENT

Figure 1:
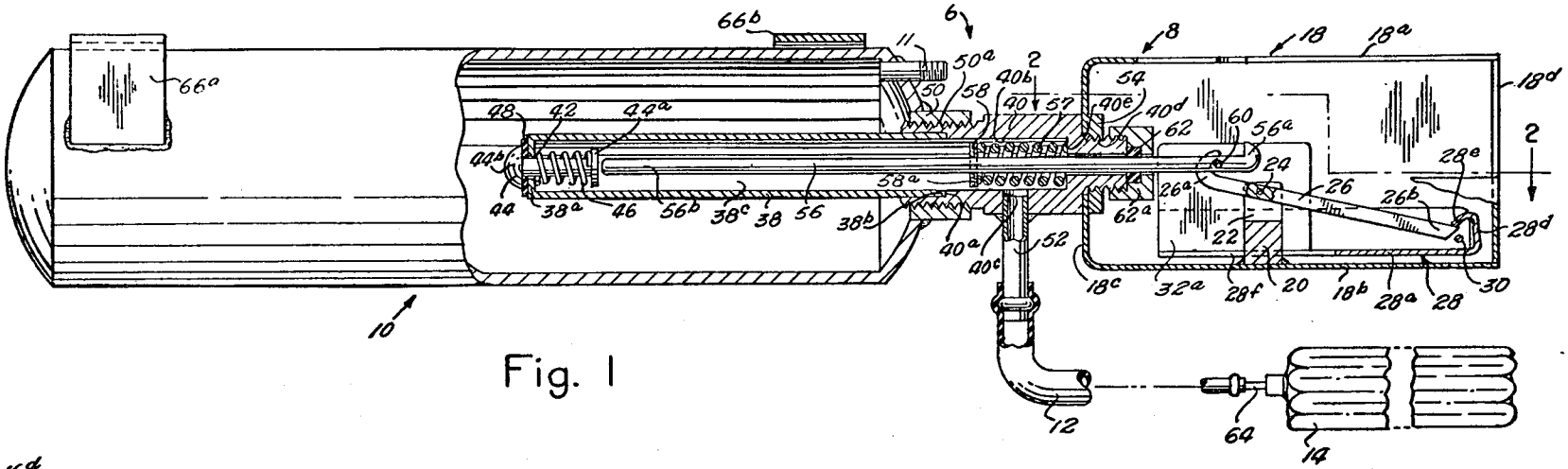
FIG. 1 is a partially sectionalized elevational view of the triggering device connected to the life raft.
Figure 2:
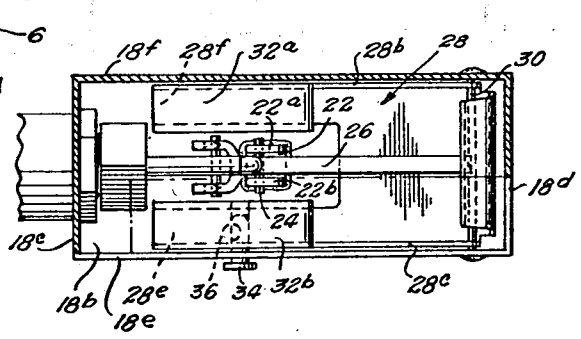
FIG. 2 is a cross-sectional view taken along line 2—2 of FIG. 1.

The numeral 6 generally designates the life raft inflating device comprising a trigger release mechanism 8, a compressed air cylinder 10 having a spring urged inlet check valve 11 secured thereto to permit filling of the cylinder 10 with compressed gas, and a hose 12 connecting the cylinder in communication with a life raft 14.

Figure 3:
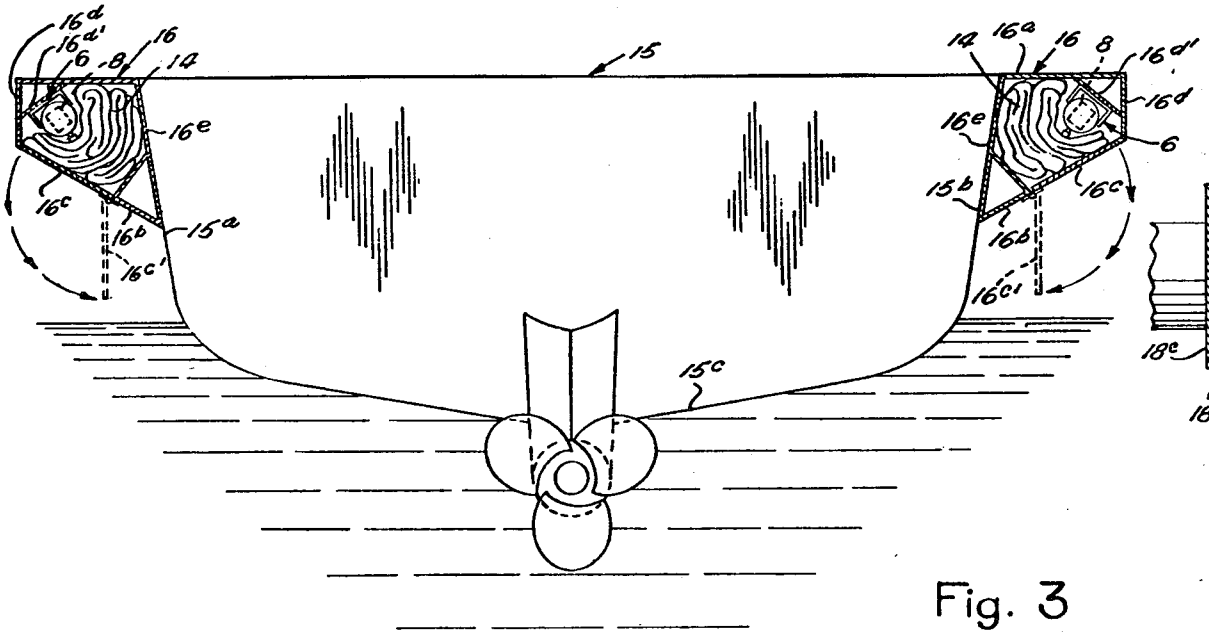
FIG. 3 is an end view of a typical boat hull with the triggering device mounted thereon.

A life raft inflating device 6 is secured in a housing 16 on each side of the boat 15 and comprises a top **16*a*, bottom 16*b*, sides 16*d* and 16*e* with a door 16*c* hingedly secured to the underside of housing 16 and pivotably moveable to the position 16*c*' shown in dashed outline (FIG. 3). The housings 16 are secured to the sides of a typical boat hull 15 comprising sides 15*a* and 15*b* connected by bottom 15*c*. Preferably a life raft inflating device 6 is mounted on each of sides 15*a* and 15*b*** such that the boat does not have to completely overturn in order to trigger the mechanism.

Referring to FIG. 1 of the drawing, the trigger release mechanism 8 is comprised of a housing 18 having upper and lower walls 18a and **18*b* and sides 18*c* and 18*d* connected by sides 18*e* and 18*f*. The lower wall 18*b* has an upwardly extending lug 20 secured to the lower wall 18*b* by means such as welding. The lug 20 has a groove 22 formed between lugs 22*a* and 22*b* and has pin 24 journalled between the two lugs 22*a* and 22*b* of groove 22 and supporting retaining arm 26**.

A counterweight assembly has a trigger retaining arm 26 with a deflected end **26*a* at one end and an outwardly extending end 26*b*. A U-shaped base member 28 comprising a base 28*a* and sides 28*b* and 28*c* extends upwardly from the sides thereof and an upwardly extending end 28*d* has a deflected end 28*e* which, when in the loaded position, extends over end 26*b* and limits the upward movement thereof. Sides 28*b* and 28*c* are journalled on a shaft 30 extending therethrough which extends into and is supported by sides 18*e* and 18*f* such that the U-shaped base member 28 is rotatable about the shaft 30 such that when the device 6 is inverted the base 28 may move to the position 28' shown in FIG. 4 of the drawing. The U-shaped base member 28 has extending forks 28*e* and 28*f* supporting weights 32*a* and 32*b* secured thereto. A locking pin 34 is journalled through wall 18*e* into passage 36 formed in weight 32 *b*** to limit the movement thereof when it is desired to prevent triggering of the inflation device.

Valve means comprising a hollow tubular sleeve 38 has an end **38*a* and valve member 44 is provided to seal cylinder 10. An external shoulder 38***b* of sleeve 38 engages internal shoulder 40*a* of threaded coupling 40 which is rigidly attached thereto. End 38*a* of sleeve 38 has an aperture 42 formed therethrough and a valve member 44 extending therethrough having spring 46 disposed between the end 38*a* and spring retaining head 44*a* of valve member 44 urging the head 44*b* of valve 44 against a resilient seat 48 secured to end 38*a*, preventing leakage of gas into the bore 38*c* of sleeve 38.

Coupling 40 is externally threaded to engage the internal threads 50*a* of coupling 50 which is rigidly secured by welding or other means to a compressed air cylinder 10. Coupling 40 has a bore 40*b* communicating with passage 40*c* formed in the side of bore 40*b* and having nipple 52 rigidly secured in passage 40*c* by welding or other means. Nipple 52 communicates with tubing 12 to form a passage for the gas to flow to inflate the life raft 14. Coupling 40 has an externally threaded end 40*d* which extends through side 18*c* of housing 18 and is secured thereto by nut 54.

Valve release rod 56 extends longitudinally through bore 40*b* of coupling 40 and bore 38*c* of sleeve 38 and is guided therethrough by an annular guide 58 which has holes 58*a* formed therein to allow gas to pass therethrough. A spring 57 is slidably disposed between the end 40*e* of bore 40*b* and the guide 58 is rigidly secured to the valve release rod 56. The valve release rod 56 has a deflected end 56*a* and a pin 60 extends through rod 56. Hooked end 26*a* of retaining arm 26 engages pin 60 when in the loaded position. A seal about end 40*d* of coupling 40 is formed by a resilient packing washer 62 held in place by internally threaded nut 62*a* which engages external threads 40*d*. End 56*b* of rod 56 is held adjacent spring head 44*a* of valve member 44 when the device is in the loaded position.

Figure 4:
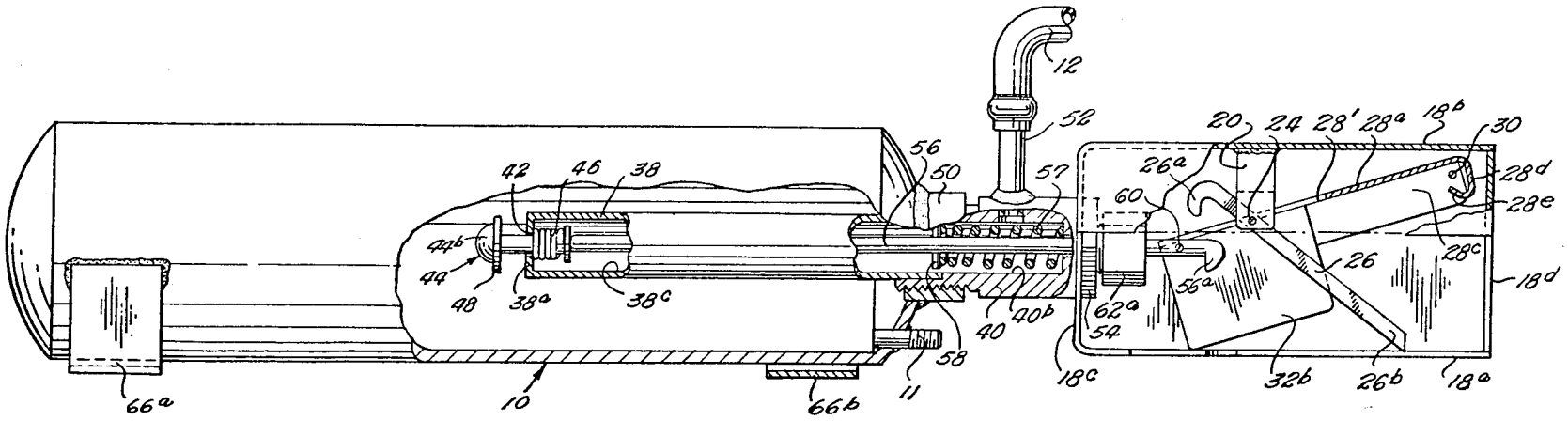
FIG. 4 is a fragmentary elevational view of the triggering device in inverted position.

Operation of the device hereinbefore described is as follows:

When the trigger release mechanism 8 is inverted the weights 32*a* and 32*b* will rotate about pivot pin 30 toward the wall 18*a*, thus moving the base member 28 to a position 28' shown in FIG. 4 of the drawing. Deflected end 28*e* of base member 28 will pivot away from end 26*b* of retaining arm 26, allowing arm 26 to move downwardly when in the inverted position thus moving deflected end 26*a* to a position to disengage pin 60 as retaining arm 26 pivots about pin 24. When pin 60 is disengaged, valve release rod 56 is urged forward by spring 57 and end 56*b* will then engage valve member 44 and move same away from seat 48 against spring 46, opening aperture 42.

The compressed gas contained in cylinders 10 will then pass through aperture 42 into sleeve 38 through bore 38*c*, through apertures 58*a* in guide member 58 through passage 40*c*, through nipple 52 into tubing 12, to inflate the life raft 14. A check valve 64 is preferably secured to the life raft 14 so that upon disengagement of tubing 12 therefrom the air will not leak from life raft 14 so that if the boat 15 sinks the life raft 14 will not be pulled under.

The cylinder 10 preferably has brackets 66*a* and 66*b* secured thereto by means such as welding in order to provide means to mount the inflating device 6 to mounting board 16*d'* which is secured between the upper side 16*a* and side 16*d* of the housing 16. Mounting board 16*d'* is preferably mounted at a 45° angle such that when the boat has partially capsized the gravity will then pull the weights 32*a* and 32*b* toward side

18*a* of housing 18, triggering the life raft inflating device 6. It should be readily apparent that boat hull 15 need not completely capsize before the device 6 is triggered.

Figure 5:
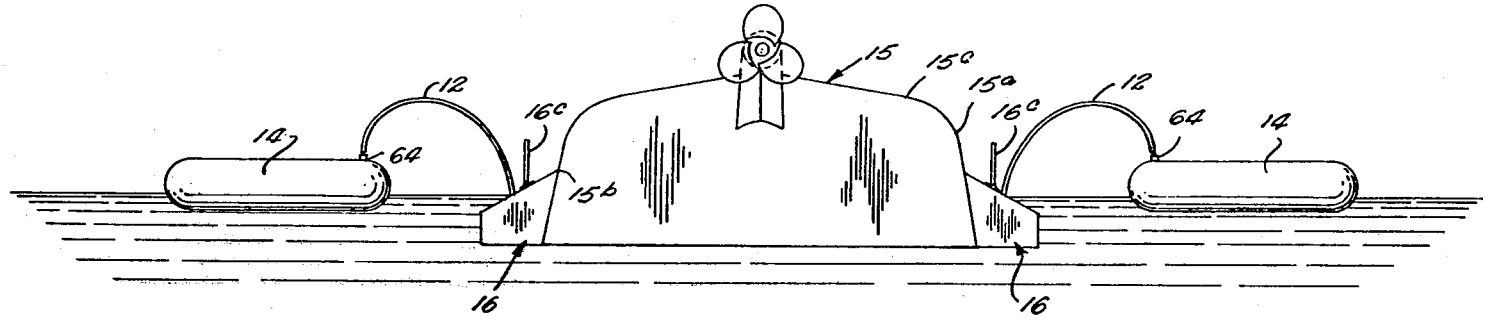
FIG. 5 is an end view of a capsized boat showing the inflated life rafts deployed from the overturned boat.

Upon triggering of the inflation device 6 compressed air will enter life raft 14 expanding it and forcing the door 16*c* of housing 16 open to a position 16*c'* and allowing the life raft 14 to expand therefrom into the surrounding water. Ample tubing 12 is provided to allow the life raft 14 to clear the boat hull 15 as illustrated in FIG. 5 of the drawing.

From the foregoing it should be readily apparent that the embodiment hereinbefore discussed accomplishes the objects of the invention hereinbefore set forth.

It should be appreciated that other and further embodiments of the invention may be devised without departing from the basic concept thereof.

Having described my invention, I claim:

1. In a device on a boat for inflating a life raft; a housing attachable to the side of a boat; a door pivotally attached to the housing; a deflated life raft disposed in the housing; a pressure cylinder carried in the housing; a trigger housing attached to the cylinder; a tubular member extending into the pressure cylinder having a hollow bore therein communicating with the life raft; a spring urged valve member in the inner end of the tubular member normally closing same; a valve release rod extending from the trigger housing into the bore of the tubular member and having an end arranged to engage the valve member to open same when released; spring means normally urging the rod toward the valve member; a trigger arm pivotally attached in the trigger housing having means thereon disengageably attachable to the valve release rod to hold the valve release rod in retracted position against said spring member; a counterweight support assembly having one end pivotally attached to the trigger housing and a weight on the opposite end thereof; and means on the pivoted end of the counterweight support assembly, engaging the other end of the trigger arm to hold same in set position in engagement with the valve release rod whereby capsizing the trigger housing the weights on the counterweight assembly will pivot the counterweight support assembly to release the end of the trigger arm from the counterweight assembly to release the valve release rod to cause the valve release rod to move in response to spring action against the valve to open same and allow pressurized gas therein to enter and expand the life raft which upon expansion opens the pivoted door and expels the expanded life raft from the housing.

2. The combination called for in claim 1 wherein the valve member comprises: a resilient valve seat having a passage therethrough; a valve rod slideably extending through the passage; a valve head on the outer end of the valve rod; a spring retainer head on the inner end of the valve rod; and a spring disposed about the valve rod between the spring retainer head and the inner side of the seat.

3. The combination called for in claim 2 wherein the valve release rod is arranged to engage the spring retaining head upon release thereof to push the valve head away from the seat.

4. The combination called for in claim 1 with the addition of a seal assembly on the inner side of the trigger housing through which the valve release rod is slideably disposed; a hollow fitting connected between the counterweight housing and the cylinder; and a pressurized gas conduit connected between the hollow fitting and the life raft.

5. The combination called for in claim 1 wherein the pivoted door is disposed at the lower side of the housing and is arranged to open upwardly when the boat is capsized to release the raft from the housing.

6. The combination called for in claim 1 wherein there is a housing on each side of the boat with a life raft and inflating assembly therein.

7. The combination called for in claim 1 wherein the counterweight comprises spaced weights on opposite sides of the trigger arm and actuating pin connection whereby they will not interfere with the setting of the trigger arm and actuating pin.

8. A counterweight trigger mechanism for automatically inflating a life raft mounted on a boat comprising, a pressure cylinder; valve means to control the flow of gas under pressure from the cylinder; a tubular member extending into the cylinder with the valve means slideably mounted in the outer end thereof; a housing secured to the end of said tubular member; a valve release rod extending into the tubular member arranged to contact the valve member to open same; spring means urging the valve member to closed position; a counterweight assembly attached to the cylinder, said valve release rod being slideably extendable into the counterweight assembly; a counterweight base pivotally mounted in the housing; a deflected end on the counterweight base adjacent the pivotal mounting; a weight disposed on the other end of the counterweight base; a trigger arm pivotally mounted to the counterweight assembly housing; means on one end of the trigger arm to disengageably engage the inner end of the valve release rod, the other end of the trigger arm being disposed below the deflected end of the counterweight base; pivot means pivotally attaching the counterweight base to the housing disposed on the opposite end thereof from the said weight; a deflated life raft; a conduit extending between the tubular member and the life raft; spring means normally urging the valve release rod toward the valve member, whereby upon inverting the counterweight assembly the counterweight base is rotated to release the trigger arm to allow same to pivot to release same from the valve release rod to allow the spring means to cause the valve release rod to engage the valve member to open same, whereby compressed gas in the cylinder will be admitted to the life raft through the conduit means to inflate same.

9. In a life raft inflating device, a pressurized cylinder; a deflated life raft; conduit means between the life raft and the cylinder; a valve member; resilient seat; a spring urging the valve member away from said seat; and a counterweight means adapted to hold said valve member closed until the inflating device becomes inverted when said counterweight means is actuated to release said valve member, to allow said spring to open said valve and inflate said life raft.

10. In a life raft inflating device, a pressurized cylinder; a deflated life raft; conduit means between the life raft and the cylinder; valve means normally closing the conduit means; a trigger arm; a valve release rod arranged to engage the valve means upon release; a spring urging said valve release rod toward the valve means; a hooked end on said trigger arm engageable with the valve release rod to hold the spring in retracted condition; a housing; a pivot shaft journalled through said housing; a counterweight base pivotally mounted on said pivot shaft; and an upwardly extending deflected end on the base adjacent the pivot shaft, engageable with the end of the trigger arm such that the deflected end pivots away from the trigger arm when the device is inverted, and the hooked end of the trigger arm disengages the valve release rod to allow the spring to relax and move the rod against the valve member to open same.

11. The combination called for in claim 10 with the addition of a housing attachable to a boat; a pivoted door on the housing; the said life raft inflating device being disposed in the housing whereby upon the opening of said valve the life raft will inflate to open said door to allow the inflated life raft to be expelled from the housing.

* * * * *